US005324585A

United States Patent [19]

Akiyama et al.

[11] Patent Number: 5,324,585

[45] Date of Patent: Jun. 28, 1994

[54] IMAGE RECEIVING SHEET FOR USE IN THERMAL IMAGE TRANSFER RECORDING SYSTEM

[75] Inventors: Mihoko Akiyama, Susono; Keiichi Shiokawa, Numazu; Youji Ide, Mishima, all of Japan

[73] Assignee: Ricoh Company, Ltd., Tokyo, Japan

[21] Appl. No.: 903,343

[22] Filed: Jun. 24, 1992

Related U.S. Application Data

[63] Continuation-in-part of Ser. No. 673,402, Mar. 22, 1991, abandoned.

[30] Foreign Application Priority Data

Jun. 24, 1991 [JP] Japan ..... 3-151603
Dec. 19, 1991 [JP] Japan ..... 3-336926

[51] Int. Cl.[5] ..... B41M 5/26

[52] U.S. Cl. ..... 428/409; 428/195; 428/211; 428/318.4; 428/913; 428/914

[58] Field of Search ..... 427/152; 428/195, 913, 428/914, 211, 318.4, 409; 503/203, 226

[56] References Cited

FOREIGN PATENT DOCUMENTS 0133012 2/1985 European Pat. Off. ..... 428/195

*Primary Examiner*—B. Hamilton Hess
*Attorney, Agent, or Firm*—Oblon, Spivak, McClelland, Maier & Neustadt

[57] ABSTRACT

An image receiving sheet for use in a thermal image transfer recording system, has an absorption coefficient (Ka) of 0.05 to 0.75 ml/m$^2$·(msec)$^{\frac{1}{2}}$ with respect to extra pure liquid paraffin at a pressure of 0.1 MPa when measured by the Bristow's Method (J.TAPPI No. 51-87). As such an image receiving sheet, an image receiving sheet having a recording surface with the product of (a) the absorption coefficient (Ka) with respect to the liquid paraffin (extra pure reagent) measured by the Bristow's Method (J.TAPPI No. 51-87) at a pressure of 0.1 MPa and (b) the gradient (fc) of a linear portion of a load curve obtained by a three-dimensional surface roughness analysis being in the range of 0.5 to 6.0 can be used. An image receiving sheet having a recording surface with the amount (V) of an ink transferred to the receiving sheet during 100 msec being in the range of 2.3 to 11.5 ml/m$^2$ can also be used. The amount (V) is obtained from (a) the absorption coefficient (Ka) and (b) the surface roughness index (Vr) of the recording surface, which are measured by the Bristow's Method (J.TAPPI No. 51-87) at a pressure of 0.1 MPa, with respect to the liquid paraffin (extra pure reagent).

13 Claims, 1 Drawing Sheet

IMAGE RECEIVING SHEET FOR USE IN THERMAL IMAGE TRANSFER RECORDING SYSTEM

This application is a continuation-in-part of application Ser. No. 07/673,402, filed Mar. 22, 1991, now abandoned.

BACKGROUND OF THE INVENTION

1. Field of the Invention

The present invention relates to an image receiving sheet for use in a thermal image transfer recording system, and more particularly to an image receiving sheet capable of receiving images from a thermal image transfer recording medium which can be repeatedly used for thermal printing.

2. Discussion of Background

Recording apparatus, such as a printer and a facsimile apparatus, using the thermal image transfer recording method, is now widespread. This is because the recording apparatus of this type is relatively small in size and can be produced inexpensively, and the maintenance is simple.

In the conventional thermal image transfer recording medium for use with the thermal image transfer recording apparatus, a single ink layer is merely formed on a support. When such a recording medium is used for printing images, the portions of the ink layer heated by a thermal head are completely transferred to an image receiving sheet at only one-time printing. Therefore, the recording medium can be used only once, and can never be used repeatedly. The conventional recording medium is thus disadvantageous from the economical point of view.

In order to overcome the above drawback in the prior art, there have been proposed the following methods:

(1) A microporous ink layer is formed on a support so that a thermofusible ink impregnated in the ink layer can gradually ooze out as disclosed in Japanese Laid-Open Patent Applications 54-68253 and 55-105579;

(2) A porous film is provided on an ink layer formed on a support so that the amount of an ink which oozes out from the ink layer can be controlled as disclosed in Japanese Laid-Open Patent Application 58-212993; and (3) An adhesive layer is interposed between an ink layer and a support so that an ink of the ink layer can be gradually exfoliated in the form of a thin ink layer from the support when images are printed as disclosed in Japanese Laid-Open Patent Applications 60-127191 and 60-127192.

However, when images are printed on an image receiving sheet in general use by using the above-mentioned thermal image transfer recording media, the image density of the obtained images is lowered or changed during the repeated printing operation.

Many proposals have also been made to eliminate the above drawback from the image receiving sheet for use in the thermal image transfer recording system.

For instance, image receiving sheets comprising a support and a coating layer with a high oil-absorbability are disclosed in Japanese Laid-Open Patent Applications 57-182487, 61-217289, 61-248791, 61-266296, 61-284486, 62-162590, 62-202788, 62-160287, 62-257888, 62-278082, 63-19289, 63-69685, 63-178082 and 01-188392.

However, even when the aforementioned image receiving sheets with a high oil-absorbability are used for thermal image transfer recording, the obtained images lack high resolution, and high image density cannot be maintained during the repeated printing operation.

Japanese Laid-Open Patent Application 02-9688 discloses that satisfactory images can be obtained when an image receiving sheet with a surface roughness index (Vr) of 5 ml or more in accordance with the Bristow's method (J.TAPPI Testing Method for Paper and Pulp No. 51-87). When the thermal image transfer recording medium is repeatedly used for printing images on such an image receiving sheet, however, images with high resolution and high density cannot be maintained for an extended period of time.

SUMMARY OF THE INVENTION

Accordingly, an object of the present invention is to provide an image receiving sheet for use in a thermal image transfer recording system, capable of receiving images with high resolution and high density from a thermal image transfer recording medium which can be repeatedly used for thermal printing.

The object of the present invention can be achieved by an image receiving sheet for use in a thermal image transfer recording system, having an absorption coefficient (Ka) of 0.05 to 0.75 $ml/m^2 \cdot (msec)^{\frac{1}{2}}$ with respect to a liquid paraffin (extra pure reagent) whose composition and properties comply with the Japanese Industrial Standards (JIS) K 9003-1961 at a pressure of 0.1 MPa when measured by the Bristow's Method (J.TAPPI No. 51-87).

The object of the present invention can also be achieved by an image receiving sheet having a recording surface with the product of (a) the absorption coefficient (Ka) with respect to the liquid paraffin (extra pure reagent) measured by the Bristow's Method (J.TAPPI No. 51- 87) at a pressure of 0.1 MPa and (b) the gradient (fc) of a linear portion of a load curve obtained by a three-dimensional surface roughness analysis being in the range of 0.5 to 6.0.

Furthermore, the object of the present invention can also be achieved by an image receiving sheet having a recording surface with the amount (V) of an ink transferred to the receiving sheet during 100 msec being in the range of 2.3 to 11.5 $ml/m^2$. The amount (V) is obtained from (a) the absorption coefficient (Ka) and (b) the surface roughness index (Vr) of the recording surface of the receiving sheet, which are measured by the Bristow's Method (J.TAPPI No. 51-87) with respect to the liquid paraffin (extra pure reagent) at a pressure of 0.1 MPa.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
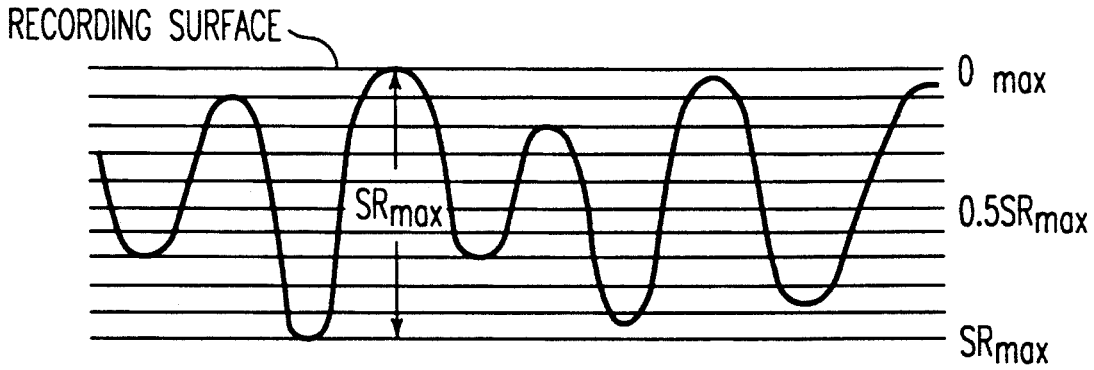
FIG. 1 is a graph showing the surface roughness of a recording surface of an image receiving sheet which is obtained by a surface roughness analysis, and constitutes a basis for obtaining a load curve with respect to the recording surface.

The absorption coefficient (Ka) of the image receiving sheet of the present invention with respect to the liquid paraffin (extra pure reagent) defined by the Japanese Industrial Standards (JIS) K 9003-1961 at a pressure of 0.1 MPa is in the range from 0.05 to 0.75 $ml/m^2 \cdot (msec)^{\frac{1}{2}}$, preferably in the range from 0.10 to 0.50 $ml/m^2 \cdot (msec)^{\frac{1}{2}}$, when measured by the Bristow's Method (J.TAPPI No. 51-87).

In the present invention, the absorption coefficient (Ka) by the Bristow's Method is obtained in accordance with J.TAPPI Paper Pulp Test Method No. 51-87. More specifically, the amount ($ml/m^2$) of the liquid paraffin transferred to a test image receiving sheet is plotted as ordinate, with respect to the square root of the absorption time as abscissa, so that the absorption curve for the liquid paraffin is obtained. The gradient of a linear portion of the obtained absorption curve is measured, so that the absorption coefficient (Ka) of the test image receiving sheet with respect to the liquid paraffin is obtained.

When the aforementioned absorption coefficient (Ka) of the image receiving sheet is less than 0.05 $ml/m^2 \cdot (msec)^{\frac{1}{2}}$ with respect to the liquid paraffin (extra pure reagent) at a pressure of 0.1 MPa, the ink receptivity of the image receiving sheet becomes poor. Therefore, the amount of an ink capable of being received by the image receiving sheet at one-time printing is not sufficient to obtain images with high image density.

On the other hand, when the absorption coefficient (Ka) of the image receiving sheet is more than 0.75 $ml/m^2 \cdot msec)^{\frac{1}{2}}$ with respect to the liquid paraffin (extra pure reagent), high image density cannot be obtained from the second printing operation since the ink contained in a thermal image transfer recording medium is excessively squeezed therefrom by the image receiving sheet at one-time printing.

Furthermore, it is preferable that the surface smoothness of the image receiving sheet according to the present invention be in the range of 200 to 2000 sec in terms of Bekk's smoothness. When the surface smoothness of the image receiving sheet of the present invention is within the above range, the images printed on the image receiving sheet have high resolution and high image density.

It is also preferable that the image receiving sheet of the present invention have a recording surface with the product of (a) the absorption coefficient (Ka) with respect to the liquid paraffin (extra pure reagent) measured by the Bristow's Method (J.TAPPI No. 51-87) at a pressure of 0.1 MPa and (b) the gradient (fc) of a linear portion of a load curve obtained by a three-dimensional surface roughness analysis being in the range of 0.5 to 6.0.

In the above case, it is preferable that the absorption coefficient (Ka) be in the range of 0.05 to 0.80 $ml/m^2 \cdot (msec)^{\frac{1}{2}}$, the gradient (fc) be 7.0 or more.

In the present invention, the above-mentioned gradient (fc) of the linear portion of the load curve with respect to the recording surface of the image receiving sheet is measured by the following three-dimensional surface roughness analysis:

(1) The maximum height (SRmax) of convex portions on the recording surface of the image receiving sheet is measured from the bottom of the image receiving sheet by a three-dimensional surface roughness feeler. The plane parallel to the bottom of the image receiving sheet, passing through the maximum height point, is defined as a reference plane "0" as shown in FIG. 1. The convex portions on the recording surface of the image receiving sheet are sliced in the direction parallel to the reference plane "0", toward the bottom of the image receiving sheet in such a manner that the slicing planes pass through the 10 equally divided points in the direction of the depth of the recording surface of the image receiving sheet. As shown in FIG. 1, the lowermost slicing plane is labeled "SRmax". The slicing plane passing through the middle of the depth of the recording surface of the image receiving sheet is labeled "0.5SRmax" as shown in FIG. 1.

Figure 2:
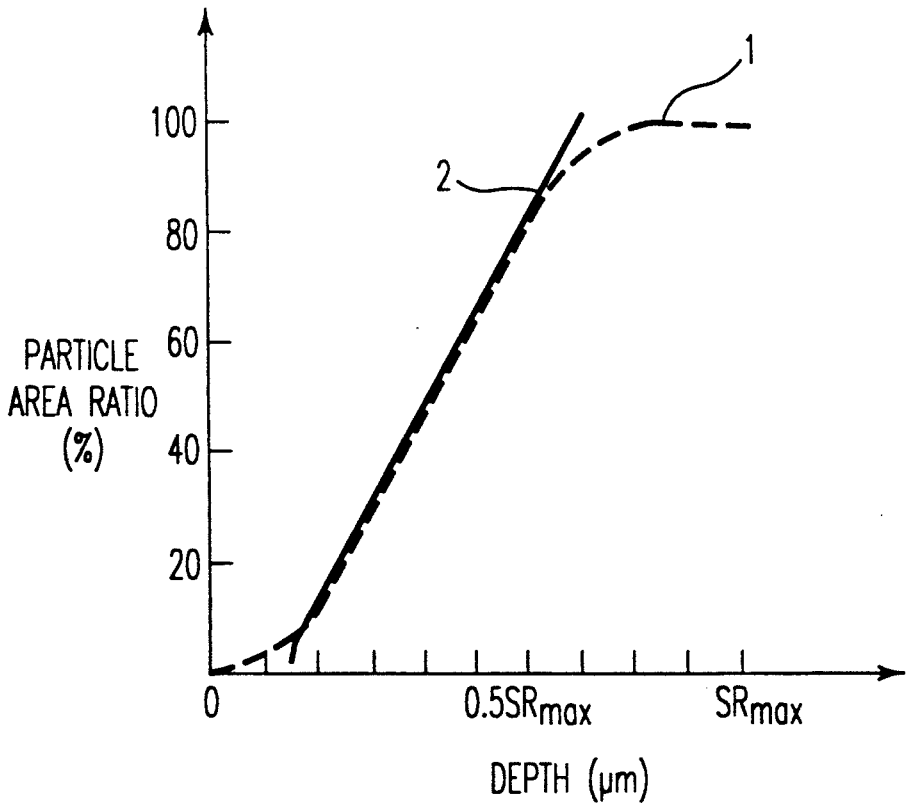
FIG. 2 is a graph showing the gradient of a linear portion of the load curve with respect to a recording surface of an image receiving sheet.

(2) The total area of the cut surface areas (which are generally referred to as the particles) in each slicing plane is measured, and the ratio of each total area to the entire cut area, for instance, the cut area at SRmax, is plotted as ordinate with respect to the depth of the recording surface of the image receiving sheet toward the slicing plane SRmax from the reference plane "0" as abscissa, and a curve 1 indicated by the broken line is obtained as shown in FIG. 2, which is called "load curve". The value of the gradient (fc) is obtained from the linear portion 2 of the load curve 1 as shown in FIG. 2.

The three-dimensional surface roughness was measured using a commercially available three-dimensional surface roughness measuring instrument ("SE-30K" (Trademark), made by Kosaka Research Center), and the obtained values of the three-dimensional surface roughness were analyzed using a three-dimensional surface roughness analyzing apparatus ("SPA-11" (Trademark), made by Kosaka Research Center) under the following conditions:

| | |
|---|---|
| Radius of feeler edge: | 2 μm |
| Force applied during the measurement: | 0.7 mN |
| Polarity switching: | Normal |
| X measured length: | 2.0 mm |
| Y feeding pitch: | 5 μm |
| Y recording limit: | 210 mm |
| X feeding rate: | 0.2 mm/S |
| Y recording pitch: | 2 mm |
| Longitudinal magnification (Z): | 500 |
| Transverse magnification (X): | 100 |
| Phase characteristics compensation: | |
| Low area cut-off: | R + W |
| High arera cut-off: | 0.08 |
| Gain: | ×1 |
| X pitch: | 5 μm |
| Number of samples: | 100 |
| Sampling mode point: | P. MODE 8 |

Especially when a thermal image transfer recording medium comprising an ink layer comprising a thermofusible ink formed on a substrate is used and the thermofusible ink is fused and transferred to the image receiving sheet, the inventors of the present invention have discovered that the following relationship with respect to the amount ($g/m^2$) of the thermofusible ink transferred to the image receiving sheet at the initial printing during the process of multiple printing holds:

$$\left[\begin{array}{c}\text{The amount of the thermo-}\\ \text{fusible ink transferred to}\\ \text{the image receiving sheet}\\ \text{at the initial printing}\end{array}\right] = a \cdot Ka \cdot fc$$

wherein a is a proportional constant, and Ka and fc are those defined previously.

The proportional constant a depends upon the printing conditions during the multiple printing such as applied energy, thermal head pressure, and recording speed.

It has not been clearly known why the above-mentioned relationship holds. However, it is considered that Ka represents the ink receptivity of the recording surface of the image receiving sheet, and fc represents the contact properties between the recording surface of the image receiving sheet and a portion of the thermal transfer recording medium from which the ink oozes out during the printing process. Therefore, it can be considered that the product of Ka and fc substantially determines the amount of the ink transferred to the image receiving sheet.

As mentioned previously, in the present invention, it is preferable that the image receiving sheet have a recording surface with the product of (a) the absorption coefficient (Ka) with respect to the liquid paraffin (extra pure reagent) measured by the Bristow's Method (J.TAPPI No. 51-87) at a pressure of 0.1 MPa and (b) the gradient (fc) of a linear portion of the load curve measured by the three-dimensional surface roughness analysis being in the range of 0.5 to 6.0, more preferably 2.0 to 6.0. When the value of above product is less than 0.5, the image density of the printed images tends to be lowered, and deteriorates during the multiple printing. When the value of the above product is less than 2.0, the deterioration of the image density during the multiple printing is not large, but the image density is slightly low. When the value of the above product is in the range of 2.0 to 6.0, the image density does not deteriorate and is high. When the value of the above product is more than 6.0, the amount of ink transferred to the receiving sheet at the initial printing is excessive, and a large amount of ink oozes out and is transferred to the receiving sheet from the thermal image transfer recording medium. As a result, the image density deteriorates after the second and subsequent printings. Therefore, the receiving sheet having the recording surface with the product of Ka and fc of more than 6.0 is not suitable for practical use.

Furthermore, when the recording surface of the image receiving sheet with the product of Ka and fc in the above-mentioned preferable range has Ka of 0.05 to 0.80 $ml/m^2 \cdot (msec)^{\frac{1}{2}}$, or fc of 7.0 or more, not only the image density of the printed images does not deteriorate during the multiple printing, but also the reproductivity of line images is excellent.

In the present invention, it is also preferable that the image receiving sheet of the present invention have a recording surface with the amount (V) of an ink transferred to the receiving sheet during 100 msec being in the range of 2.3 to 11.5 $ml/m^2$. The amount (V) is obtained from (a) the absorption coefficient (Ka) and (b) the surface roughness index (Vr) of the recording surface of the receiving sheet, which are measured by the Bristow's Method (J.TAPPI No. 51-87) with respect to the liquid paraffin (extra pure reagent) at a pressure of 0.1 MPa.

In the above case, it is preferable that the surface roughness index (Vr) be in the range of 1.80 to 11.0 $ml/m^2$.

The ink transfer amount (V) is the amount ($ml/m^2$) of the ink transferred to the receiving sheet within an absorption time [T). This is obtained from the absorption coefficient (Ka) and the surface roughness index (Vr) in accordance with the following equation:

$$V = Vr + KaT^{\frac{1}{2}}$$

As mentioned previously, the absorption coefficient (Ka) by the Bristow's Method is obtained in accordance with J.TAPPI Paper Pulp Test Method No. 51-87. The amount ($ml/m^2$) of the liquid paraffin transferred to a test image receiving sheet is plotted as ordinate with respect to the square root of the absorption time as abscissa, so that an absorption curve is obtained. The gradient of a linear portion of the obtained absorption curve is measured, so that the absorption coefficient (Ka) with respect to the liquid paraffin is obtained.

The surface roughness index (Vr) can be obtained from the intercept of the absorption curve obtained in the same manner as above.

The absorption time (T) is the period of time during which the thermofusible ink contained in the thermal image transfer recording medium can be absorbed by the image receiving sheet. In the present invention, the amount (V) of an ink transferred to the receiving sheet is obtained by setting the absorption time at 100 msec.

As mentioned previously, it is preferable that the image receiving sheet of the present invention have a recording surface having an ink transfer amount (V) in the range of 2.3 to 11.5 $ml/m^2$ obtained from Ka and Vr for the absorption time (T) of 100 msec. When the ink transfer amount (V) is less than 2.3 $ml/m^2$, the ink receptivity of the receiving sheet is poor, and high image density cannot be obtained, although the deterioration of the image density of the printed images is not seriously caused during the multiple printing. When the ink transfer amount (V) is more than 11.5 $ml/m^2$, the amount of the ink transferred to the receiving sheet at the initial printing is excessive, and a large amount of ink oozes out and is transferred to the receiving sheet from the thermal image transfer recording medium. As a result, the image density of the printed images is caused to deteriorate after the second printing. Therefore, the receiving sheet having the recording surface with the ink transfer amount (V) of more than 11.5 $ml/m^2$ is not suitable for practical use.

Furthermore, when the recording surface of the receiving sheet with the ink transfer amount (V) in the above-mentioned preferable range has a surface roughness index (Vr) of 1.80 to 11.0 $ml/m^2$, not only the image density of the printed images does not deteriorate during the multiple printing, but also the reproductivity of line images is excellent.

When the recording surface of each of the above-mentioned image receiving sheets according to the present invention has voids with a diameter of 50 $\mu m$ or more and a depth of 20 $\mu m$ or more, measured by the three-dimensional surface roughness analysis, with a number of 60 or less per surface area of 1.00 $mm^2$, the resolution of the printed images is improved. The dot reproductivity and line reproductivity are influenced by the diameter, the depth and the number of the voids on the recording surface of the image receiving sheet. When the number of the voids having the diameter and the depth in the above range is larger than 70 per surface area of 1.00 $mm^2$, some dots may not be printed, so that the resolution of the printed images tends to become poor.

The absorption coefficient [Ka) of the image receiving sheet can be controlled by adjusting the amount of a coating liquid for forming a coating layer of the image receiving sheet and changing the physical properties of the above-mentioned coating liquid.

In the present invention, as far as the product of Ka and fc, or V is maintained in the previously mentioned preferable range, any kinds of methods can be employed for manufacturing the image receiving sheet. The above values can be adjusted by appropriately selecting chemicals, resins and sizing agents to be added, the beating degree of the material for the sheet and the drying and calendering conditions during the manufacturing process of the image receiving sheet. When synthetic paper is employed as the image receiving sheet according to the present invention, the above values ca be obtained by setting the extent of foaming, and adducts to be contained in the recording surface of the sheet.

Conventionally known thermal image transfer recording media can be used for the thermal image transfer recording system in the present invention. For example, the following thermal image transfer recording media can be employed: a thermal image transfer recording medium comprising a microporous ink layer formed on a substrate, which contains a thermofusible ink in the ink layer and from which the thermofusible ink gradually oozes out; a thermal image transfer recording medium comprising an ink layer and a microporous film successively overlaid on a substrate, with the amount of the ink transferred to the receiving sheet being controlled; and a thermal image transfer recording medium comprising an ink layer on a substrate with an adhesive layer interposed between the ink layer and the substrate, with the ink contained in the ink layer being gradually exfoliated and transferred to the receiving sheet. Particularly, it is preferable to use the thermal image transfer medium comprising the microporous ink layer or the microporous film.

Other features of this invention will become apparent in the course of the following description of exemplary embodiments, which are given for illustration of the invention and are not intended to be limiting thereof.

EXAMPLE 1

A mixture of the following components was dispersed to prepare a coating liquid for a coating layer of an image receiving sheet.

| | Parts by Weight |
|---|---|
| Calcined clay | 100 |
| Styrene - butadiene copolymer | 20 |
| Sodium polyacrylate | 20 |

The above-prepared coating liquid was coated on a sheet of high quality paper by a wire bar in a coating amount of 30 $g/m^2$, so that a coating layer was provided. The coating layer was then subjected to calendering with the application of a pressure of 60 kgf/cm, whereby an image receiving sheet according to the present invention was obtained.

The absorption coefficient (Ka) with respect to the liquid paraffin (extra pure reagent) at a pressure of 0.1 MPa of the above-prepared image receiving sheet was 0.51 $ml/m^2 \cdot msec)^{\frac{1}{2}}$, and the surface smoothness thereof was 165 sec in terms of Bekk's smoothness. The gradient (fc) of the linear portion of the load curve obtained by the three-dimensional surface roughness analysis was 7.20. The number of the voids having a diameter of 50 μm or more and a depth of 20 μm or more was 5/$mm^2$.

EXAMPLE 2

A mixture of the following components was dispersed to prepare a coating liquid for a coating layer of an image receiving sheet.

| | Parts by Weight |
|---|---|
| Silica | 100 |
| Water-soluble polyester resin | 40 |
| 10% aqueous solution of casein | 100 |
| Calcium stearate | 2 |
| Water | 63 |

The above-prepared coating liquid was coated on a sheet of high quality paper by a wire bar in a coating amount of 10 $g/m^2$, so that a coating layer was provided. The coating layer was then subjected to calendering, whereby an image receiving sheet according to the present invention was obtained.

The absorption coefficient [Ka) with respect to the liquid paraffin (extra pure reagent) at a pressure of 0.1 MPa of the above-prepared image receiving sheet was 0.35 $ml/m^2 \cdot (msec)^{\frac{1}{2}}$, and the surface smoothness thereof was 530 sec in terms of Bekk's smoothness. The gradient (fc) of the linear portion of the load curve obtained by the three-dimensional surface roughness analysis was 9.80. The number of the voids having a diameter of 50 μm or more and a depth of 20 μm or more was 20/$mm^2$.

EXAMPLE 3

A hand-made paper was prepared by using the following components.

| | Parts by Weight |
|---|---|
| LBKP (with C.S.F.* of 350 ml) | 80 |
| NBKP (with C.S.F.* of 350 ml) | 20 |
| Calcium carbonate | 3 |
| Water | 7 |
| Cationic starch | 0.02 |

*C.S.F. = Canadian Standard Freeness

The above-prepared hand-made paper was dipped into a mixture of a 5% aqueous solution of a commercially available polyvinyl alcohol "PVA 217" (Trademark), made by Kuraray Co., Ltd., and a commercially available waterproofing agent "Polyfix" (Trademark), made by Showa Highpolymer Co., Ltd., at a temperature of 70° C. for 5 minutes. The hand-made paper was then pressed by a pressing machine and dried at 60° C. Thus, an image receiving sheet according to the present invention was obtained.

The absorption coefficient (Ka) with respect to the liquid paraffin (extra pure reagent) at a pressure of 0.1 MPa of the above-prepared image receiving sheet was 0.26 $ml/m^2 \cdot (msec)^{\frac{1}{2}}$, and the surface smoothness thereof was 360 sec in terms of Bekk's smoothness. The gradient (fc) of the linear portion of the load curve obtained by the three-dimensional surface roughness analysis was 11.1. The number of the voids having a diameter of 50 μm or more and a depth of 20 μm or more was 10/mm$^2$.

EXAMPLE 4

A sheet of a commercially available synthetic paper was used as an image receiving sheet of the present invention.

The absorption coefficient (Ka) with respect to the liquid paraffin (extra pure reagent) at a pressure of 0.1 MPa of the above-prepared image receiving sheet was 0.25 ml/m$^2$·(msec)$^{1/2}$. The surface roughness index (Vr) was 3.35 ml/m$^2$. The number of the voids having a diameter of 50 μm or more and a depth of 20 μm or more was 0.

EXAMPLE 5

The procedure for preparing the image receiving sheet in Example 2 was repeated except that the 100 parts by weight of silica and the 40 parts by weight of water-soluble polyester resin employed in Example 2 were respectively replaced by 70 parts by weight of silica and 70 parts by weight of water-soluble polyester resin, whereby an image receiving sheet according to the present invention was obtained.

The absorption coefficient (Ka) with respect to the liquid paraffin (extra pure reagent) at a pressure of 0.1 MPa of the above-prepared image receiving sheet was 0.15 ml/m$^2$·(msec)$^{1/2}$. The surface roughness index (Vr) was 2.90 ml/m$^2$. The number of the voids having a diameter of 50 μm or more and a depth of 20 μm or more was 0.

EXAMPLE 6

The procedure for preparing the image receiving sheet in Example 1 was repeated except that the calendering pressure was changed to 20 kgf/cm, whereby an image receiving sheet according to the present invention was obtained.

The absorption coefficient (Ka) with respect to the liquid paraffin (extra pure reagent) at a pressure of 0.1 MPa of the above-prepared image receiving sheet was 0.46 ml/m$^2$·(msec)$^{1/2}$. The gradient (fc) of the linear portion of the load curve obtained by the three-dimensional surface roughness analysis was 6.00. The number of the voids having a diameter of 50 μm or more and a depth of 20 μm or more was 30/mm$^2$.

EXAMPLE 7

A sheet of a commercially available coated paper was used as an image receiving sheet of the present invention.

The absorption coefficient (Ka) with respect to the liquid paraffin (extra pure reagent) at a pressure of 0.1 MPa of the above-prepared image receiving sheet was 0.23 ml/m$^2$·(msec)$^{1/2}$. The surface roughness index (Vr) was 3.93 ml/m$^2$. The gradient (fc) of the linear portion of the load curve obtained by the three-dimensional surface roughness analysis was 12.50. The number of the voids having a diameter of 50 μm or more and a depth of 20 μm or more was 85/mm$^2$.

EXAMPLE 8

A sheet of a commercially available synthetic paper was used as an image receiving sheet of the present invention.

The absorption coefficient (Ka) with respect to the liquid paraffin (extra pure reagent) at a pressure of 0.1 MPa of the above-prepared image receiving sheet was 0.05 ml/m$^2$·(msec)$^{1/2}$. The gradient (fc) of the linear portion of the load curve obtained by the three-dimensional surface roughness analysis was 15.00. The number of the voids having a diameter of 50 μm or more and a depth of 20 μm or more was 10/mm$^2$.

COMPARATIVE EXAMPLE 1

A sheet of a commercially available paper, "TRW-1" (Trademark), made by Jujo Paper Mfg. Co., Ltd., was used as a comparative image receiving sheet.

The absorption coefficient (Ka) with respect to the liquid paraffin (extra pure reagent) at a pressure of 0.1 MPa of the above comparative image receiving sheet was 1.01 ml/m$^2$·(msec)$^{1/2}$, and the surface smoothness thereof was 205 sec in terms of Bekk's smoothness. The gradient (fc) of the linear portion of the load curve obtained by the three-dimensional surface roughness analysis was 7.15. The surface roughness index (Vr) was 3.93 ml/m$^2$. The number of the voids having a diameter of 50 μm or more and a depth of 20 μm or more was 75/mm$^2$.

COMPARATIVE EXAMPLE 2

A sheet of a commercially available art paper was used as a comparative image receiving sheet.

The absorption coefficient (Ka) with respect to the liquid paraffin (extra pure reagent) at a pressure of 0.1 MPa of the above comparative image receiving sheet was 0.03 ml/m$^2$·(msec)$^{1/2}$, and the surface smoothness thereof was 2050 sec in terms of Bekk's smoothness. The gradient (fc) of the linear portion of the load curve obtained by the three-dimensional surface roughness analysis was 6.80. The number of the voids having a diameter of 50 μm or more and a depth of 20 μm or more was 0.

COMPARATIVE EXAMPLE 3

A sheet of a commercially available coated paper was used as a comparative image receiving sheet.

The absorption coefficient (Ka) with respect to the liquid paraffin (extra pure reagent) at a pressure of 0.1 MPa of the above comparative image receiving sheet was 0.78 ml/m$^2$·(msec)$^{1/2}$. The surface roughness index (Vr) was 4.34 ml/m$^2$. The number of the voids having a diameter of 50 μm or more and a depth of 20 μm or more was 55/mm$^2$.

Table 1 shows Ka, fc, Vr, the number of the voids, Ka x fc, and V of each of the above obtained image receiving sheets according to the present invention and comparative image receiving sheets.

TABLE 1

| Example No. | Ka | fc | Vr | Number of Voids (*) | Ka × fc | V |
|---|---|---|---|---|---|---|
| Ex. 1 | 0.51 | 7.20 | — | 5 | 3.67 | — |
| Ex. 2 | 0.35 | 9.80 | — | 20 | 3.43 | — |
| Ex. 3 | 0.26 | 11.10 | — | 10 | 2.89 | — |
| Ex. 4 | 0.25 | — | 3.35 | 0 | — | 5.85 |
| Ex. 5 | 0.15 | — | 2.90 | 0 | — | 4.40 |
| Ex. 6 | 0.46 | 6.00 | — | 30 | 2.76 | — |
| Ex. 7 | 0.23 | 12.50 | 3.93 | 85 | 2.88 | 6.23 |
| Ex. 8 | 0.05 | 15.00 | — | 10 | 0.75 | — |
| Comp. Ex. 1 | 1.01 | 7.15 | 3.93 | 75 | 7.22 | 14.03 |
| Comp. Ex. 2 | 0.03 | 6.80 | — | 0 | 0.20 | — |

TABLE 1-continued

| Example No. | Ka | fc | Vr | Number of Voids (*) | Ka × fc | V |
|---|---|---|---|---|---|---|
| Comp. Ex. 3 | 0.78 | — | 4.34 | 55 | — | 12.14 |

(*)Number of Voids:
the number of the voids with a diameter of 50 μm or more and a depth of 20 μm or more per surface area of 1.00 $mm^2$ The above-prepared image receiving sheets of the present invention and comparative image receiving sheets were subjected to a thermal printing test. In this thermal printing test, a thermal image transfer recording medium prepared by the following method was employed.

PREPARATION OF THERMAL IMAGE TRANSFER RECORDING MEDIUM

Preparation of Thermofusible Ink

A mixture of the following components was placed in a sand mill vessel, and dispersed at 110° C. to obtain a homogeneous ink dispersion.

| | Parts by Weight |
|---|---|
| Carbon black | 15 |
| Candelilla wax | 60 |
| Polyethylene oxide wax | 23 |
| Terpene resin (dispersant) | 2 |

The resulting ink dispersion was cooled to 65° C. Ten parts by weight of a low-melting oil-soluble dye, benzol black and 675 parts by weight of a mixed solvent of methyl ethyl ketone and toluene (2:1) were added to the above ink dispersion, and the thus obtained mixture was dispersed again at 32° C. The mixture was then cooled to room temperature, whereby a gelled thermofusible ink was obtained.

Formation of First Ink Layer

A mixture for forming a first ink layer was prepared by dispersing the following components.

| | Parts by Weight |
|---|---|
| Gelled thermofusible ink (prepared in the above) | 10 |
| 20% mixed solution of methyl ethyl ketone and toluene (2:1) of a vinyl chloride - vinyl acetate copolymer | 3 |
| Azobisisobutyronitrile | 0.1 |

One surface of a polyethylene terephthalate (PET) film with a thickness of 4.5 μm was treated to be heat-resistant.

The above-prepared mixture was coated in a thickness of 8 μm on the opposite surface of the PET film, and then dried at 75° C., so that a first ink layer was provided on the PET film.

Formation of Second Ink Layer

A mixture for forming a second ink layer was prepared by dispersing the following components.

| | Parts by Weight |
|---|---|
| Gelled thermofusible ink (prepared in the above) | 10 |
| 20% mixed solution of methyl ethyl ketone and toluene (2:1) of a vinyl chloride - vinyl acetate copolymer | 3 |

The above-prepared mixture was coated in a thickness of 2 μm on the above-prepared first ink layer, and then dried at 110° C. to form a porous second ink layer on the first ink layer. Thus, a thermal image transfer recording medium was prepared.

The above-prepared thermal image transfer recording medium was loaded in a thermal line printer, and images were transferred four times to each of the image receiving sheets of the present invention and the comparative image receiving sheets from the same portion of the recording medium using a printing pattern consisting of a solid area and "CODE 39" bar codes under the following conditions:

| | |
|---|---|
| Thermal head: | Line thin-film head type (8 dots/mm) |
| Platen pressure: | 280 gf/cm |
| Peeling angle against image receiving sheet: | 45° |
| Energy applied from thermal head: | 17 $mJ/mm^2$ |
| Printing speed: | 4 inch/sec |

The density of the image obtained by each time of 1st, 2nd, 3rd and 4th printings was measured by a Macbeth reflection-type densitometer RD-914. The bar code reading ratio of the obtained images was measured by a bar code laser checker ("LC2811" (Trademark), made by Symbol Technology Co., Ltd.). The results are shown in Table 2.

TABLE 2

| | 1st | | 2nd | | 3rd | | 4th | |
|---|---|---|---|---|---|---|---|---|
| Example No. | Image Density | Bar Code Reading Ratio (%) | Image Density | Bar Code Reading Ratio (%) | Image Density | Bar Code Reading Ratio (%) | Image Density | Bar Code Reading Ratio (%) |
| Example 1 | 1.55 | 100 | 1.36 | 92 | 1.28 | 84 | 1.15 | 82 |
| Example 2 | 1.41 | 96 | 1.37 | 96 | 1.26 | 90 | 1.20 | 86 |
| Example 3 | 1.40 | 100 | 1.43 | 92 | 1.38 | 92 | 1.29 | 90 |
| Example 4 | 1.41 | 100 | 1.50 | 100 | 1.42 | 100 | 1.33 | 100 |
| Example 5 | 1.04 | 100 | 1.15 | 100 | 1.10 | 100 | 1.07 | 100 |
| Example 6 | 1.46 | 85 | 1.40 | 80 | 1.23 | 61 | 1.11 | 43 |
| Example 7 | 1.43 | 81 | 1.41 | 75 | 1.36 | 62 | 1.25 | 53 |
| Example 8 | 0.74 | 90 | 0.76 | 90 | 0.71 | 90 | 0.78 | 88 |
| Comparative Example 1 | 1.58 | 100 | 0.92 | 51 | 0.40 | 12 | 0.18 | 0 |
| Comparative Example 2 | 0.40 | 14 | 0.40 | 24 | 0.33 | 10 | 0.29 | 0 |
| Comparative | 1.48 | 88 | 1.01 | 46 | 0.38 | 5 | 0.21 | 0 |

TABLE 2-continued

| Example No. | 1st Image Density | 1st Bar Code Reading Ratio (%) | 2nd Image Density | 2nd Bar Code Reading Ratio (%) | 3rd Image Density | 3rd Bar Code Reading Ratio (%) | 4th Image Density | 4th Bar Code Reading Ratio (%) |
|---|---|---|---|---|---|---|---|---|
| Example 3 | | | | | | | | |

The data shown in the above Table 1 and Table 2 indicates that images with high image density can be repeatedly obtained on the image receiving sheets according to the present invention, that is, the image receiving sheets having a recording surface with the absorption coefficient (Ka) in the range of 0.05 to 0.75 $ml/m^2 \cdot (msec)^{\frac{1}{2}}$, a recording surface with the product of Ka and the gradient (fc) of the linear portion of the load curve obtained by the three-dimensional surface roughness analysis being in the range of 0.5 to 6.0, or a recording surface with the ink transfer amount (V) measured by Ka and the surface roughness index (Vr) being in the range of 2.3 to 11.5 $ml/m^2$.

Furthermore, when the recording surface of an image receiving sheet having Ka×fc in the above preferable range, or V in the above preferable range, has fc of 7.0 or more, or the voids with a diameter of 50 μm or more and a depth of 20 μm or more at the ratio of $60/mm^2$ or less, the image receiving sheet has excellent dot and line reproductivity. Moreover, the resolution of the obtained images is improved. Therefore, the image receiving sheet of the present invention has excellent bar code reading ratio.

What is claimed is:

1. An image receiving sheet for use in a thermal image transfer recording system comprising a paper substrate and a resinous image receiving layer thereon, having an absorption coefficient (Ka) of 0.05 to 0.75 $ml/m^2 \cdot (msec)^{\frac{1}{2}}$ with respect to an extra pure liquid paraffin defined by the Japanese Industrial Standards (JIS) K 9003-1961 at a pressure of 0.1 MPa when measured by the Bristow's Method (J.TAPPI No. 51-87).

2. The image receiving sheet as claimed in claim 1, further having a surface smoothness of 200 to 2000 sec in terms of Bekk's smoothness.

3. An image receiving sheet for use in a thermal image transfer recording system, comprising a recording surface with the product of (a) the absorption coefficient (Ka) of said recording surface with respect to an extra pure liquid paraffin defined by the Japanese Industrial Standards (JIS) K 9003-1961 measured by the Bristow's Method (J.TAPPI No. 51-87) at a pressure of 0.1 MPa and (b) the gradient (fc) of a linear portion of a load curve measured by the three-dimensional surface roughness analysis being in the range of 0.5 to 6.0.

4. The image receiving sheet as claimed in claim 3, wherein said product of (a) said absorption coefficient (Ka) and (b) said gradient (fc) is in the range of 2.0 to 6.0.

5. The image receiving sheet as claimed in claim 3, wherein said absorption coefficient (Ka) is in the range of 0.05 to 0.80 $ml/m^2 \cdot (msec)^{\frac{1}{2}}$.

6. The image receiving sheet as claimed in claim 5, wherein said recording surface has voids with a diameter of 50 μm or more and a depth of 20 μm or more measured by the three-dimensional surface roughness analysis, and the number thereof is 60 or less per surface area of 1.00 $mm^2$.

7. The image receiving sheet as claimed in claim 3, wherein said gradient (fc) is 7.0 or more.

8. The image receiving sheet as claimed in claim 7, wherein said recording surface has voids with a diameter of 50 μm or more and a depth of 20 μm or more measured by the three-dimensional surface roughness analysis, and the number thereof is 60 or less per surface area of 1.00 $mm^2$.

9. The image receiving sheet as claimed in claim 3, wherein said recording surface has voids with a diameter of 50 μm or more and a depth of 20 μm or more measured by the three-dimensional surface roughness analysis, and the number thereof is 60 or less per surface area of 1.00 $mm^2$.

10. An image receiving sheet for use in a thermal image transfer recording system, comprising a recording surface with an ink transfer amount (V) during 100 msec, obtained from (a) the absorption coefficient (Ka) and (b) the surface roughness index (Vr) of said recording surface, which are measured by the Bristow's Method (J.TAPPI No. 51-87) at a pressure of 0.1 MPa, with respect to an extra pure liquid paraffin defined by the Japanese Industrial Standards (JIS) K 9003-1961, being in the range of 2.3 to 11.5 $ml/m^2$.

11. The image receiving sheet as claimed in claim 10, wherein said surface roughness index (Vr) is in the range of 1.80 to 11.00 $m/m^2$.

12. The image receiving sheet as claimed in claim 11, wherein said recording surface has voids with a diameter of 50 m or more and a depth of 20 m or more measured by the three-dimensional surface roughness analysis, and the number thereof is 60 or less per surface area of 1.00 $mm^2$.

13. The image receiving sheet as claimed in claim 10, wherein said recording surface has voids with a diameter of 50 μm and a depth of 20 μm or more measured by the three-dimensional surface roughness analysis, and the number thereof is 60 or less per surface area of 1.00 $mm^2$.

* * * * *

UNITED STATES PATENT AND TRADEMARK OFFICE
CERTIFICATE OF CORRECTION

PATENT NO. : 5,324,585

DATED : June 28, 1994

INVENTOR(S) : Mihoko Akiyama, et al

It is certified that error appears in the above-identified patent and that said Letters Patent is hereby corrected as shown below:

Column 6, line 8, "absorption time [T)." should read --absorption time (T).--

Column 7, line 8, "coefficient [Ka)" should read --coefficient (Ka)--

Column 7, line 23, "values ca be" should read --values can be--

Column 8, line 30, " The absorption coefficient [Ka)" should read --The absorption coefficient (Ka)--

Column 14, line 47, "of 50 m or more and a depth of 20 m" should read --of 50 μm or more and a depth of 20 μm--

UNITED STATES PATENT AND TRADEMARK OFFICE

CERTIFICATE OF CORRECTION

PATENT NO. : 5,324,585

DATED : June 28, 1994

INVENTOR(S) : Mihoko Akiyama, et al.

It is certified that error appears in the above-indentified patent and that said Letters Patent is hereby corrected as shown below:

Column 14, line 47, "of 50 m or more and a depth of 20 m" should read --of 50 μm or more and a depth of 20 μm--

Signed and Sealed this

Twenty-second Day of August, 1995

Bruce Lehman

*Attest:*

BRUCE LEHMAN

*Attesting Officer*

*Commissioner of Patents and Trademarks*